US005938022A

United States Patent [19]

Detloff

[11] Patent Number: 5,938,022

[45] Date of Patent: Aug. 17, 1999

[54] PAPERBOARD BOX FOR SHIPPING OF COMPACT DISCS, CASSETTES AND SIMILAR ITEMS

[75] Inventor: Craig Detloff, Palos Verdes Estates, Calif.

[73] Assignee: Sunclipse, Inc., Buena Park, Calif.

[21] Appl. No.: 09/148,808

[22] Filed: Sep. 4, 1998

[51] Int. Cl.[6] ..... B65D 85/30

[52] U.S. Cl. ..... 206/308.1; 206/312; 206/308.3

[58] Field of Search ..... 206/15, 308.1, 206/309, 312, 307, 308.3; 220/120.011, 125

[56] References Cited

U.S. PATENT DOCUMENTS

| | | | |
|---|---|---|---|
| 2,333,798 | 11/1943 | Kner | 206/312 |
| 3,785,478 | 1/1974 | Drori | 206/312 |
| 5,662,217 | 9/1997 | Durr | 206/312 |
| 5,823,333 | 10/1998 | Mori | 206/308.1 |

*Primary Examiner*—Paul T. Sewell
*Assistant Examiner*—Nhan T. Lam
*Attorney, Agent, or Firm*—David A. Belasco; William H. Pavitt, Jr.

[57] ABSTRACT

A paperboard box for shipping of compact discs, cassettes and similar items that may be formed from a single piece of paperboard and rapidly assembled without the use of tools is described. The box comprises first and second panels, first including a rectangular bottom second section of a first predetermined height and a first predetermined width. First and second rectangular end sections are foldably joined to the upper and lower ends of the bottom panel. Upper and lower closing sections are foldably joined to the distal edges of the first and second end sections. A bendable tab element extends from the distal edge of the upper closing section and a tab element receiving slit is included in the lower closing section. The second panel includes a rectangular back section having a second predetermined height equal to the first predetermined width and a second predetermined width equal to the first predetermined height. First and second elongated rectangular side sections are foldably joined to the upper and lower ends of the back panel and first and second side closing sections are foldably joined to each of the first and second side sections. The back section includes a first perforation line, extending at a 45 degree angle, from a lower corner of the back section adjacent the bottom section to a first point in the back section. A cut line extends from the first point to a second point along the juncture of the back section and the bottom section. The first panel is foldably joined to the second panel at a second perforation line. To assemble the container the back section is folded along the first perforation line so that the back section is beneath the bottom section and then folded over the bottom section along the second perforation line. The end and side sections are then folded upwardly and the side closing sections are folded inwardly. Next the lower closing section is folded upwardly and the upper closing section is folded over the lower closing section, forming a closed container.

10 Claims, 2 Drawing Sheets

PAPERBOARD BOX FOR SHIPPING OF COMPACT DISCS, CASSETTES AND SIMILAR ITEMS

FIELD OF INVENTION

The invention pertains to a paperboard box construction. More particularly, the invention relates to a box construction adapted for shipping of compact discs, cassettes and similar items that must be protected from crushing, folding or other forces.

BACKGROUND OF THE INVENTION

Various types of paperboard boxes and containers have been devised to protect compact discs, cassettes and similar items during shipment. U.S. Pat. No. 5,419,433, issued to Harrer et al., describes a paperboard compact disc package that includes an insert sleeve to protect the compact disc. The sleeve is inserted into four slots in the corners of the package. U.S. Pat. No. 5,248,032, issued to Sheu et al., discloses a double-walled paperboard jacket designed to hold a compact disc without its jewel box. U.S. Pat. No. 5,732,818, issued to Koehn, describes a package for a compact disc formed from two parallel panels that form a circular pocket shaped to accept the disc without its jewel box. U.S. Pat. No. 4,694,954, issued to Moss, illustrates a convertible paperboard package designed to display a compact disc and to later fold into a storage container for same.

An effective design for a shipping container for compact discs, cassettes and similar items must necessarily be a compromise of various factors. It is an objective of the present invention that the container provide the required degree of protection from the forces encountered in transferring the container from one destination to another by means of automated package handling systems, trucks, automobiles and aircraft. It is a further objective that the container be light in weight to prevent excessive shipping costs. It is yet a further objective of the invention that the container is economical to produce and simple to assemble. It is a still further objective that the container provides a simple and effective means of being sealed and later opened. It is yet a further objective of the invention that the container accommodates a compact disc, cassette or similar item in its plastic case or jewel box. A final objective of the invention is that it be easily and economically manufactured from a single sheet of paperboard using conventional cutting, scoring and perforating machinery.

While features disclosed in the prior art satisfy some of the objectives of the present invention, none of the inventions found include all of the requirements identified.

SUMMARY OF THE INVENTION

The present invention addresses all of the deficiencies of prior art paperboard boxes and satisfies all of the objectives described above. A paperboard box for shipping of compact discs, cassettes and similar items may be formed from a single blank of paperboard material comprising the following components. A first paperboard panel including a rectangular bottom section. The bottom section has first and second opposed parallel edges, third and fourth opposed parallel edges normal to the first and second edges, a first predetermined height measured between the first and second edges and a first predetermined width measured between the third and fourth edges.

First and second elongated rectangular end sections are provided. Each of the end sections has first and second elongated, opposed parallel edges spaced apart by a first predetermined distance. The first end section is foldably joined at its second edge to the first edge of the bottom section and the second end section is foldably joined at its first edge to the second edge of the bottom section.

An upper closing section is provided and has first and second opposed parallel edges. The upper closing section is foldably joined at its second edge to the first edge of the first end section. A bendable tab element extends from the first edge of the upper closing section.

A lower closing section is provided and has first and second opposed parallel edges and third and fourth opposed parallel edges normal to the first and second edges. The lower closing section is foldably joined at its first edge to the second edge of the second end section. A tab element receiving slit is sized, shaped and located in the lower closing section to receive the bendable tab element.

A second paperboard panel is provided that includes a rectangular back section. The back section has first and second opposed parallel edges, third and fourth opposed parallel edges normal to the first and second edges. The back section also has a second predetermined height, measured between the first and second edges, equal to the first predetermined width and a second predetermined width, measured between the third and fourth edges, equal to the first predetermined height.

First and second elongated rectangular side sections are provided. Each of the side sections has first and second elongated, opposed parallel edges spaced apart by the first predetermined distance. The first side section is foldably joined at its second edge to first edge of the back section and the second side section is foldably joined at its first edge to second edge of the back section.

First and second elongated rectangular side closing sections are provided. Each of the side closing sections has first and second elongated, opposed parallel edges. The first side closing section is foldably joined at its second edge to the first edge of the first side section and the second side closing section is foldably joined at its first edge to the second edge of the second side section.

The back section includes a first perforation line extending, at a 45 degree angle to the fourth edge of the back section, from the intersection of the fourth edge and the second edge of the back section to a first point in the back section. The back section also includes a cut line extending from the first point to a second point on the fourth edge. The first point is spaced from the fourth edge by a distance no greater than one half of the second predetermined width.

The second panel is foldably joined to the third edge of the bottom section of the first panel by a second perforation line. The second perforation line is coincident with the fourth edge of the back section of the second panel.

To assemble the paperboard box the second panel is folded along the first perforation line to the extent that the second panel is located beneath the first panel. Next the second panel is folded over the first panel along the second perforation line. The first and second elongated rectangular side sections are then folded upwardly from the back section, and the first and second elongated rectangular side closing sections are folded inwardly from their respective first and second elongated rectangular side closing sections. This forms a cavity into which a Compact Disc, cassette tape or similar item may be received.

The first and second elongated rectangular end sections are then folded upwardly from the bottom section of the first panel. Next the lower closing section is folded inwardly over the cavity, and the upper closing section is folded over the lower closing section. When the bendable tab element is inserted into the tab element receiving slit, a closed shipping box may be formed.

In a variant of the invention the angle formed between the first perforation line and the cut line is a right angle and the second point is adjacent the intersection of the first edge of the bottom section and the third edge of the bottom section.

In another variant of the invention the lower closing section of the first panel includes first and second relief cuts. The first cut is located at the juncture of the second and third edges of the lower closing section and said second cut is located at the juncture of the second and fourth edges of the lower closing section. When the upper closing section is folded over the lower closing section the bendable tab element may be more easily inserted into the tab element receiving slit.

In yet another variant of the invention the bendable tab element includes a first edge and a second edge. Each of the edges extends upwardly from the first edge of the upper closing section. The bendable tab element includes first and second clearance notches. The first notch is located at the juncture of the first edge of the tab element and the first edge of the upper closing section. The second notch is located at the juncture of the second edge of the tab element and the first edge of the upper closing section.

When the bendable tab element is inserted into the tab element receiving slit the first and second clearance notches will engage the retaining slit thereby more securely retaining the tab element within the receiving slit.

DETAILED DESCRIPTION OF THE PREFERRED EMBODIMENT

Figure 1:
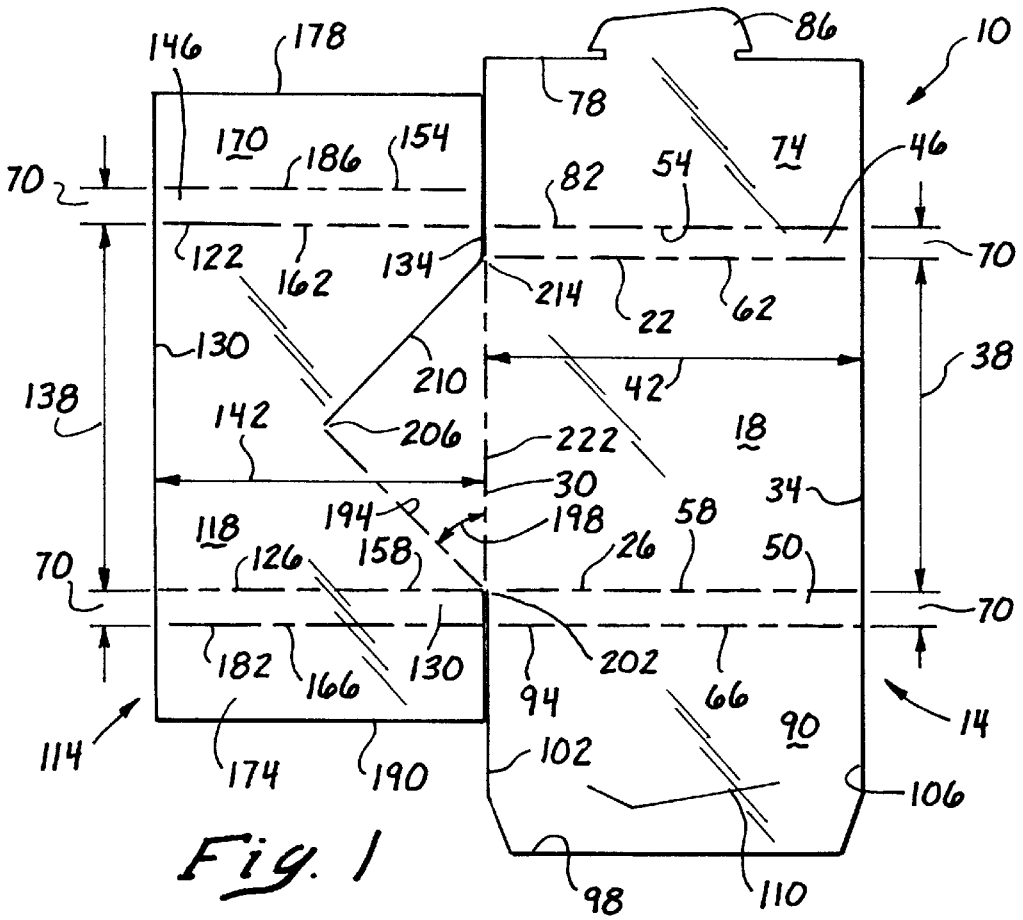
FIG. 1 is a plan view of the preferred embodiment of the invention.

FIG. 1 illustrates a die-cut blank for a paperboard box 10 for shipping of compact discs, cassettes and similar items. As shown in FIGS. 1–5, the invention comprises the following components. A first paperboard panel 14 including a rectangular bottom section 18. The bottom section 18 has first 22 and second 26 opposed parallel edges, third 30 and fourth 34 opposed parallel edges normal to the first 22 and second 26 edges, a first predetermined height 38 measured between the first 22 and second 26 edges and a first predetermined width 42 measured between the third 30 and fourth 34 edges.

First 46 and second 50 elongated rectangular end sections are provided. Each of the end sections 46, 50 has first 54, 58 and second 62, 66 elongated, opposed parallel edges spaced apart by a first predetermined distance 70. The first end section 46 is foldably joined at its second edge 62 to the first edge 22 of the bottom section 18 and the second end section 50 is foldably joined at its first edge 58 to the second edge 26 of the bottom section 18.

An upper closing section 74 is provided and has first 78 and second 82 opposed parallel edges. The upper closing section 74 is foldably joined at its second edge 82 to the first edge 54 of the first end section 46. A bendable tab element 86 extends from the first edge 78 of the upper closing section 74.

A lower closing section 90 is provided and has first 94 and second 98 opposed parallel edges and third 102 and fourth 106 opposed, parallel edges normal to the first 94 and second 98 edges. The lower closing section 90 is foldably joined at its first edge 94 to the second edge 66 of the second end section 50. A tab element receiving slit 110 is sized, shaped and located in the lower closing section 90 to receive the bendable tab element 86.

A second paperboard panel 114 is provided that includes a rectangular back section 118. The back section 118 has first 122 and second 126 opposed parallel edges, third 130 and fourth 134 opposed, parallel edges normal to the first 122 and second 126 edges. The back section 118 also has a second predetermined height 138, measured between the first 122 and second 126 edges, equal to the first predetermined width 42 and a second predetermined width 142, measured between the third 130 and fourth 134 edges, equal to the first predetermined height 38.

First 146 and second 150 elongated rectangular side sections are provided. Each of the side sections 146, 150 has first 154, 158 and second 162, 166 elongated, opposed parallel edges spaced apart by the first predetermined distance 70. The first side section 146 is foldably joined at its second edge 162 to first edge 122 of the back section 118 and the second side section 150 is foldably joined at its first edge 158 to second edge 126 of the back section 118.

First 170 and second 174 elongated rectangular side closing sections are provided. Each of the side closing sections 170, 174 has first 178, 182 and second 186, 190 elongated, opposed parallel edges. The first side closing section 170 is foldably joined at its second edge 186 to the first edge 154 of the first side section 146 and the second side closing section 174 is foldably joined at its first edge 182 to the second edge 166 of the second side section 150.

The back section 118 includes a first perforation line 194 extending, at a 45 degree angle 198 to the fourth edge 134 of the back section 118, from the intersection 202 of the fourth edge 134 and the second edge 126 of the back section 118 to a first point 206 in the back section 118. The back section 118 also includes a cut line 210 extending from the first point 206 to a second point 214 on the fourth edge 134. The first point 206 is spaced from the fourth edge 134 by a distance 218 no greater than one half of the second predetermined width 142.

The second panel 114 is foldably joined to the third edge 30 of the bottom section 18 of the first panel 14 by a second perforation line 222. The second perforation line 222 is coincident with the fourth edge 134 of the back section 118 of the second panel 114.

Figure 2:
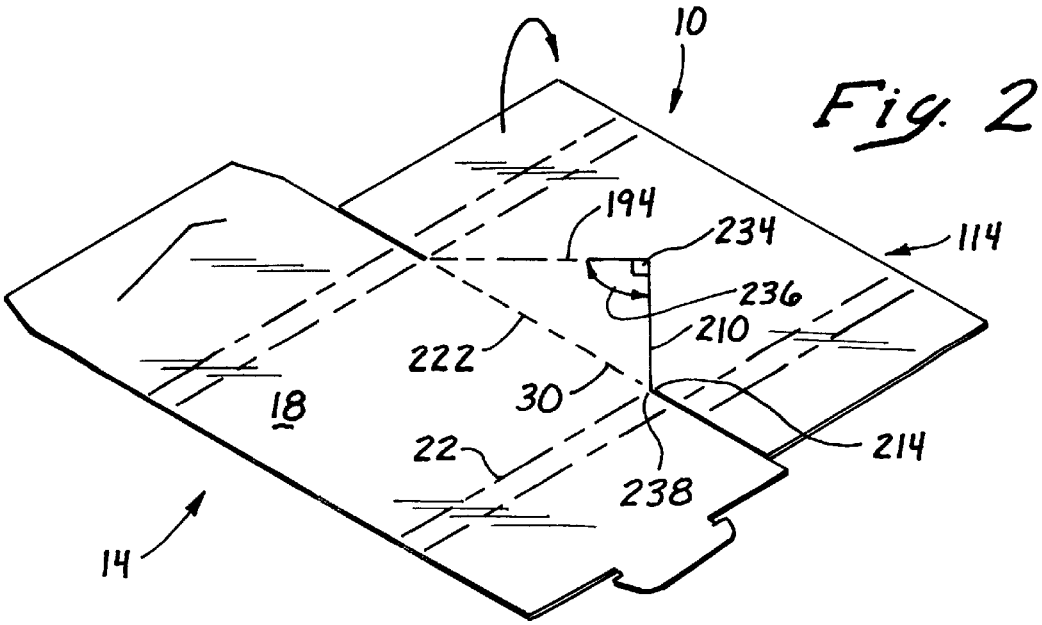
FIG. 2 is a perspective view of the FIG. 1 embodiment indicating the direction of the fold along the first perforation line.
Figure 3:
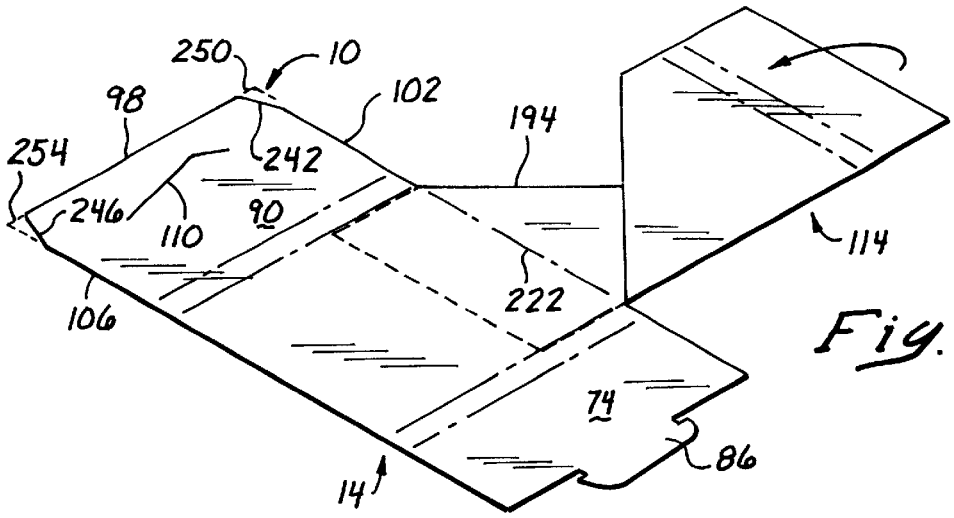
FIG. 3 is a perspective view the FIG. 1 embodiment illustrating the second panel folded along the first perforation line and disposed behind the first panel.
Figure 4:
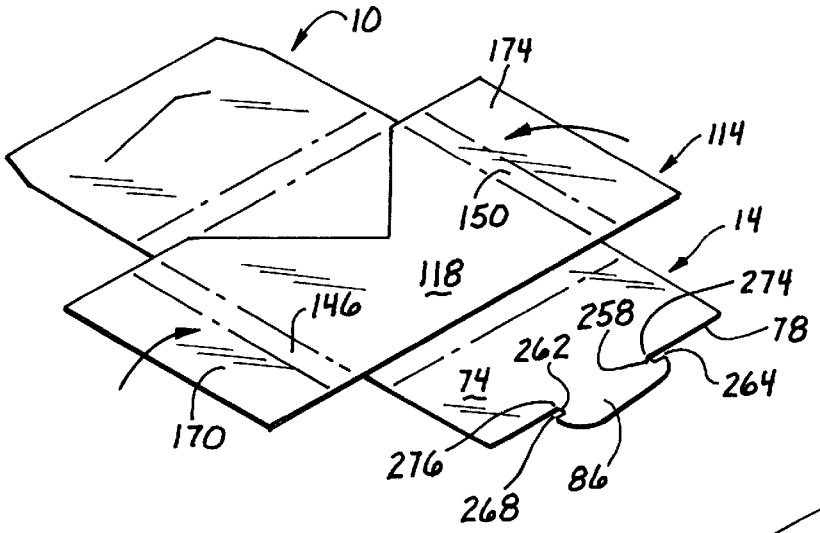
FIG. 4 is a perspective view of the FIG. 1 embodiment illustrating the second panel folded over the first panel along the second perforation line.
Figure 5:
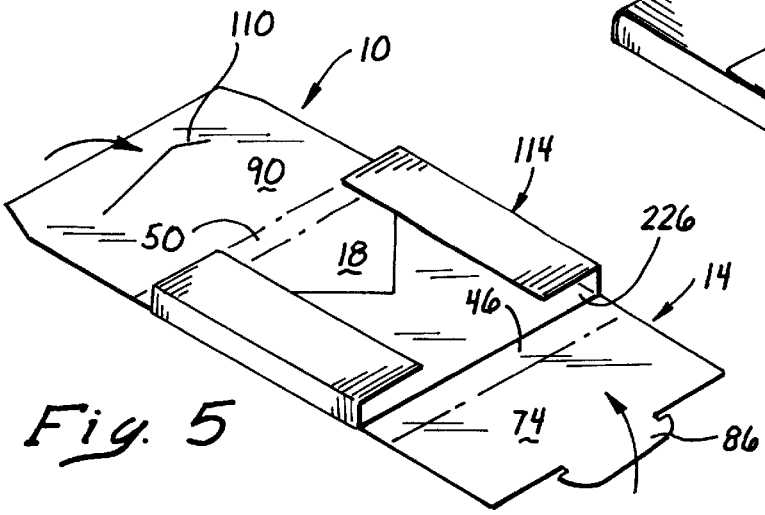
FIG. 5 is a perspective view of the FIG. 1 embodiment illustrating the first and second elongated re, r side closing sections folded inwardly to form a cavity.

As shown in FIGS. 2–6 the paperboard box 10 may be assembled by folding the second panel 114 along the first perforation line 194 (FIG. 2) to the extent that the second panel 114 is located beneath the first panel 14 (FIG. 3). Next, as illustrated in FIG. 4, the second panel 114 is folded over the first panel 14 along the second perforation line 222. The first 146 and second 150 elongated rectangular side sections are then folded upwardly from the back section 118, and the first 170 and second 174 elongated rectangular side closing sections are folded inwardly from their respective first 146 and second 150 elongated rectangular side sections. As seen in FIG. 5, this forms a cavity 226 into which a Compact Disc, cassette tape or similar item may be received.

Figure 6:
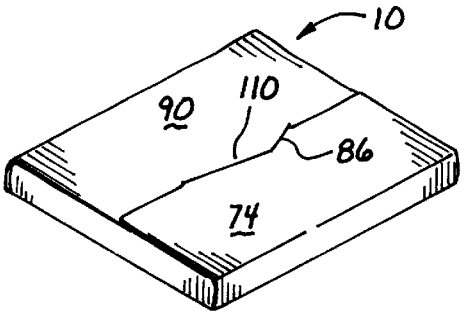
FIG. 6 is a perspective view of the FIG. 1 embodiment illustrating the closed shipping box with the bendable tab element inserted into the receiving slit.

The first 46 and second 50 elongated rectangular end sections are then folded upwardly from the bottom section 18 of the first panel 14. Next the lower closing section 90 is folded inwardly over the cavity 226, and the upper closing section 74 is folded over the lower closing section 90. As shown in FIG. 6, when the bendable tab element 86 is inserted into the tab element receiving slit 110, a closed shipping box 10 may be formed.

As illustrated in FIG. 2, in a variant of the invention the angle 230 formed between the first perforation line 194 and the cut line 210 is a right angle 234 and the second point 214 is adjacent the intersection 238 of the first edge 22 of the bottom section 18 and the third edge 30 of the bottom section 18.

As shown in FIG. 3, in another variant of the invention the lower closing section 90 of the first panel 14 includes first 242 and second 246 relief cuts. The first cut 242 is located at the juncture 250 of the second 98 and third 102 edges of the lower closing section 90 and said second cut 246 is located at the juncture 254 of the second 98 and fourth 106 edges of the lower closing section 90. When the upper closing section 74 is folded over the lower closing section 90 the bendable tab element 86 may be more easily inserted into the tab element receiving slit 110.

As illustrated in FIG. 4, in yet another variant of the invention the bendable tab element 86 includes a first edge 258 and a second edge 262. Each of the edges 258, 262 extends upwardly from the first edge 78 of the upper closing section 74. The bendable tab element 86 includes first 264 and second 268 clearance notches. The first notch 264 is located at the juncture 272 of the first edge 258 of the tab element 86 and the first edge 78 of the upper closing section 74. The second notch 268 is located at the juncture 276 of the second edge 262 of the tab element 86 and the first edge 78 of the upper closing section 74.

As illustrated in FIG. 6, when the bendable tab element 86 is inserted into the tab element receiving slit 110 the first 264 and second 268 clearance notches will engage the retaining slit 110, thereby more securely retaining the tab element 86 within the receiving slit 110.

I claim:

1. A paperboard shipping box for compact discs, cassettes and similar items, comprising:

a first paperboard panel, said first panel including:

a rectangular bottom section, said bottom section having an upper end, a lower end, first and second sides, a first predetermined height and a first predetermined width;

first and second elongated rectangular end sections, having first and second opposed parallel edges, said edges being spaced apart by a first predetermined distance;

said end sections being foldably joined to the upper end and lower end of the bottom section;

an upper closing section foldably joined to a distal edge of the first end section;

a bendable tab element extending from a distal edge of the upper closing section;

a lower closing section foldably joined to a distal edge of the second end section;

a tab element receiving slit sized, shaped and disposed in the lower closing section to receive the bendable tab element;

a second paperboard panel, said second panel including:

a rectangular back section, said back section having upper and lower ends, first and second sides, a second predetermined height equal to the first predetermined width and a second predetermined width equal to the first predetermined height;

first and second elongated rectangular side sections, each of said side sections having first and second elongated opposed parallel edges, said edges being spaced apart by the first predetermined distance;

one of said side sections being foldably joined to the upper end of the back section the other side section being foldably joined to the lower end of the back section;

first and second side closing sections, each of said side closing sections having first and second elongated opposed parallel edges;

each of said side closing sections being foldably joined to a distal edge of one of the first and second side sections;

said back section including a first perforation line extending at a 45 degree angle to the second side of the back section from the intersection of said second side and the lower end of the back section to a first point in the back section, and a cut line extending from said first point to a second point on the second side of the back section, said second point being spaced from the second side of the back section of the second panel by a distance no greater than one half of the second predetermined width;

said second panel being foldably joined to the first side of the bottom section of the first panel by a second perforation line coincident with the second side of the back panel; and whereby, when the second panel is folded along the first perforation line to the extent that the second panel is disposed beneath the first panel, and the second panel is folded over the first panel along the second perforation line, and the first and second elongated rectangular side sections are folded upwardly from the back section, and the first and second elongated rectangular side closing sections are folded inwardly from their respective first and second elongated rectangular side sections there is formed a cavity into which a Compact Disc, cassette tape or similar item may be received, and when the first and second elongated rectangular end sections are folded upwardly from the bottom section of the first panel, and the lower closing section is folded upwardly over the cavity, and the upper closing section is folded over the lower closing section and the bendable tab element is inserted into the tab element receiving slit, a closed shipping box may be formed.

2. A one-piece, planar, paperboard blank for forming the paperboard box of claim 1.

3. A paperboard shipping box for compact discs, cassettes and similar items, comprising:

a first paperboard panel, said first panel including:

a rectangular bottom section, said bottom section having first and second opposed parallel edges, third and fourth opposed parallel edges normal to the first and second edges, a first predetermined height measured between the first and second edges and a first predetermined width measured between the third and fourth edges;

first and second elongated rectangular end sections, each of said end sections having first and second elongated opposed parallel edges, said edges being spaced apart by a first predetermined distance;

said first end section being foldably joined at its second edge to the first edge of the bottom section;

said second end section being foldably joined at its first edge to the second edge of the bottom section;

an upper closing section having first and second opposed parallel edges and being foldably joined at its second edge to the first edge of the first end section;

a bendable tab element extending from the first edge of the upper closing section;

a lower closing section having first and second opposed parallel edges and third and fourth opposed parallel edges normal to the first and second edges, and being foldably joined at its first edge to the second edge of the second end section;

a tab element receiving slit sized, shaped and disposed in the lower closing section to receive the bendable tab element;

a second paperboard panel, said second panel including:

a rectangular back section, said back section having first and second opposed parallel edges, third and fourth opposed parallel edges normal to the first and second edges, a second predetermined height measured between the first and second edges equal to the first predetermined width and a second predetermined width measured between the third and fourth edges equal to the first predetermined height;

first and second elongated rectangular side sections, each of said side sections having first and second elongated opposed parallel edges, said edges being spaced apart by the first predetermined distance;

said first side section being foldably joined at its second edge to first edge of the back section;

said second side section being foldably joined at its first edge to second edge of the back section;

first and second elongated rectangular side closing sections, each of said side closing sections having first and second elongated opposed parallel edges;

said first side closing section being foldably joined at its second edge to the first edge of the first side section;

said second side closing section being foldably joined at its first edge to the second edge of the second side section;

said back section including a first perforation line extending at a 45 degree angle to the fourth edge of the back section from the intersection of said fourth edge and the second edge of the back section to a first point in the back section, and a cut line extending from said first point to a second point on said fourth edge, said first point being spaced from the fourth edge by a distance no greater than one half of the second predetermined width;

said second panel being foldably joined to the third edge of the bottom section of the first panel by a second perforation line coincident with the fourth edge of the back section of the second panel; and whereby, when the second panel is folded along the first perforation line to the extent that the second panel is disposed beneath the first panel, and the second panel is folded over the first panel along the second perforation line and the first and second elongated rectangular side sections are folded upwardly from the back section, and the first and second elongated rectangular side closing sections are folded inwardly from their respective first and second elongated rectangular side sections, there is formed a cavity into which a Compact Disc, cassette tape or similar item may be received, and when the first and second elongated rectangular end sections are folded upwardly from the bottom section of the first panel, and the lower closing section is folded inwardly over the cavity, and the upper closing section is folded over the lower closing section, and the bendable tab element is inserted into the tab element receiving slit, a closed shipping box may be formed.

4. A paperboard box for shipping of compact discs, cassettes and similar items as described in claim 2, wherein:

the angle formed between the first perforation line and the cut line is a right angle; and the second point is adjacent the intersection of the first edge of the bottom section and the third edge of the bottom section.

5. A one-piece, planar, paperboard blank for forming the paperboard box of claim 4.

6. A paperboard box for shipping of compact discs, cassettes and similar items as described in claim 2, wherein:

the lower closing section of the first panel includes first and second relief cuts, said first cut being disposed at the juncture of the second and third edges of the lower closing section and said second cut being disposed at the juncture of the second and fourth edges of the lower closing section;

whereby, when the upper closing section is folded over the lower closing section the bendable tab element may be more easily inserted into the tab element receiving slit.

7. A one-piece, planar, paperboard blank for forming the paperboard box of claim 6.

8. A paperboard box for shipping of compact discs, cassettes and similar items as described in claim 3, wherein:

said bendable tab element includes a first edge and a second edge, each of said edges extending upwardly from the first edge of the upper closing section;

said bendable tab element includes first and second clearance notches, said first notch being disposed at the juncture of the first edge of the tab element and the first edge of the upper closing section and said second notch being disposed at the juncture of the second edge of the tab element and the first edge of the upper closing section; and whereby, when the bendable tab element is inserted into the tab element receiving slit said first and second clearance notches would engage the retaining slit, thereby more securely retaining the tab element within the receiving slit.

9. A one-piece, planar, paperboard blank for forming the paperboard box of claim 8.

10. A one-piece, planar, paperboard blank for forming the paperboard box of claim 3.

* * * * *